US009928776B2

(12) United States Patent
Kim

(10) Patent No.: US 9,928,776 B2
(45) Date of Patent: Mar. 27, 2018

(54) READOUT CIRCUIT AND ORGANIC LIGHT EMITTING DISPLAY DEVICE HAVING THE SAME

(71) Applicant: SAMSUNG DISPLAY CO., LTD., Yongin-si, Gyeonggi-do (KR)

(72) Inventor: Jin-Woo Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 31 days.

(21) Appl. No.: 15/059,848

(22) Filed: Mar. 3, 2016

(65) Prior Publication Data

US 2017/0039952 A1 Feb. 9, 2017

(30) Foreign Application Priority Data

Aug. 5, 2015 (KR) ..... 10-2015-0110599

(51) Int. Cl.
*G09G 3/3266* (2016.01)
*G09G 3/3275* (2016.01)
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2320/0295* (2013.01); *G09G 2320/043* (2013.01); *G09G 2320/0693* (2013.01)

(58) Field of Classification Search
CPC ..... G09G 3/3266; G09G 3/3275; G09G 2320/045; G09G 2320/0233; G09G 2310/027; G09G 2310/0294; G09G 2310/0291
See application file for complete search history.

(56) References Cited

U.S. PATENT DOCUMENTS

2010/0156766 A1* 6/2010 Levey ..... G09G 3/3233 345/78
2013/0050292 A1 2/2013 Mizukoshi
2014/0022289 A1 1/2014 Lee et al.
2014/0176625 A1 6/2014 Yoon et al.

* cited by examiner

*Primary Examiner* — Charles Hicks
(74) *Attorney, Agent, or Firm* — Lewis Roca Rothgerber Christie LLP

(57) ABSTRACT

An organic light emitting display device includes a display panel including a plurality of pixels, a scan driver configured to provide a scan signal to the pixels via a plurality of scan lines, a data driver configured to provide a data signal to the pixels via a plurality of data lines, and a readout circuit connected to the pixels via a plurality of readout lines, the readout circuit including a current-voltage converter configured to convert a current flowing through one of the readout lines into a first voltage, an analog-digital converter configured to convert the first voltage or a second voltage of the one of the readout lines into a digital data, and a switching circuit configured to control a connection among the one of the readout lines, the current-voltage converter, and the analog-digital converter.

20 Claims, 11 Drawing Sheets

READOUT CIRCUIT AND ORGANIC LIGHT EMITTING DISPLAY DEVICE HAVING THE SAME

CROSS REFERENCE TO RELATED APPLICATIONS

This application claims, under 35 U.S.C. § 119, priority to and benefit of Korean patent Application No. 10-2015-0110599 filed on Aug. 5, 2015, the entire disclosure of which is hereby incorporated by reference herein.

BACKGROUND

1. Field

Aspects of embodiments of the inventive concept relate to display devices. More particularly, example embodiments of the inventive concept relate to a readout circuit and an organic light emitting display device including the readout circuit.

2. Related Art

An organic light emitting diode includes an organic layer between two electrodes, namely, an anode and a cathode. Positive holes from the anode are combined with electrons from the cathode in the organic layer between the anode and the cathode to emit light. The organic light emitting diode has a variety of advantages such as a wide viewing angle, a rapid response speed, relatively thin thickness, and low power consumption.

An organic light emitting display device includes a plurality of pixels. Driving transistors included in the pixels deteriorate over time as they are driven. When a transistor characteristic deviation between the pixels occurs due to this deterioration of the driving transistors of the pixels, a stripe pattern can be recognized and the display quality of the organic light emitting display device can be degraded.

SUMMARY

Aspects of embodiments of the present invention provide an organic light emitting display device capable of increasing the opening ratio of the display panel and improving the display quality.

Aspects of embodiments of the present invention provide a readout circuit capable of measuring a threshold voltage and a mobility of a driving transistor.

According to some example embodiments, the organic light emitting display device includes a display panel including a plurality of pixels, a scan driver configured to provide a scan signal to the pixels via a plurality of scan lines, a data driver configured to provide a data signal to the pixels via a plurality of data lines, and a readout circuit connected to the pixels via a plurality of readout lines, the readout circuit including a current-voltage converter configured to convert a current flowing through one of the readout lines into a first voltage, an analog-digital converter configured to convert the first voltage or a second voltage of the one of the readout lines into a digital data, and a switching circuit configured to control a connection among the one of the readout lines, the current-voltage converter, and the analog-digital converter.

The switching circuit may include a first switch between the one of the readout lines and a first reference power source, a second switch between the one of the readout lines and the analog-digital converter, a third switch between the one of the readout lines and the current-voltage converter, a fourth switch between the current-voltage converter and the analog-digital converter, and a fifth switch between the analog-digital converter and a reset power source.

The first switch may be configured to be turned on during a display period. The second switch and the third switch may be configured to be turned off during the display period.

The second switch may be configured to be turned on in at least a part of a voltage sensing period. The third switch, the fourth switch, and the fifth switch may be configured to be turned off during the voltage sensing period.

The first switch may be configured to be turned on during at least a part of the voltage sensing period.

The first switch and the second switch may be turned off during a current sensing period. The third switch and the fourth switch may be turned on during the current sensing period.

The fifth switch may be configured to be turned on during at least a part of the current sensing period.

The analog-digital converter may include a sampling-holding circuit configured to sample and hold the first voltage or the second voltage so as to output a readout voltage; and an analog-digital converting circuit configured to convert the readout voltage into the digital data.

The current-voltage converter may include an amplifier including a first input terminal connected to the one of the readout lines via the switching circuit, a second input terminal connected to a second reference power source, and an output terminal connected to the analog-digital converter via the switching circuit, and a feedback capacitor connected between the output terminal of the amplifier and the first input terminal of the amplifier.

The switching circuit may include a sixth switch between the first input terminal of the amplifier and the second input terminal of the amplifier.

The sixth switch may be configured to be turned on during at least a part of a current sensing period.

Each of the pixels may include a first transistor including a gate electrode connected to a first node, a first electrode a first power source, and a second electrode connected to a second node, a second transistor including a gate electrode connected to one of the scan lines, a first electrode connected to one of the data lines, and a second electrode connected to the first node, a third transistor including a gate electrode connected to the one of the scan lines, a first electrode connected to the second node, and a second electrode connected to one of the readout lines, a storage capacitor connected between the first node and the second node, and an original emitting diode including a first electrode connected to the second node and a second electrode selectively connected to the first power source or a second power source.

The second electrode of the original emitting diode may be configured to be connected to the second power source during a display period and connected to the first power source during a voltage sensing period and a current sensing period.

At least two pixels connected to one of the scan lines may be all connected to one of the readout lines.

First, second, and third pixels connected to one of the scan lines may all be connected to one of the readout lines. The first, second, and third pixels may respectively include a red color organic light emitting diode, a green color organic light emitting diode, and a blue color organic light emitting diode.

In example embodiments, first pixel may receive a first data voltage as the data signal during a voltage sensing period and a current sensing period. The second and third pixels may receive a second voltage corresponding to a black data as the data signal during the voltage sensing period and the current sensing period.

According to some example embodiments, a readout circuit includes a current-voltage converter configured to convert a current flowing through a readout line into a first voltage, an analog-digital converter configured to convert the first voltage or a second voltage of the readout line into a digital data, and a switching circuit configured to control a connection among the readout line, the current-voltage converter, and the analog-digital converter.

The switching circuit may include a first switch between the readout line and a first reference power source, a second switch between the readout line and the analog-digital converter, a third switch between the readout line and the current-voltage converter, a fourth switch between the current-voltage converter and the analog-digital converter, and a fifth switch between the analog-digital converter and a reset power source.

The current-voltage converter may include an amplifier including a first input terminal connected to the readout line via the switching circuit, a second input terminal connected to a second reference power source, and an output terminal connected to the analog-digital converter via the switching circuit, and a feedback capacitor connected between the output terminal of the amplifier and the first input terminal of the amplifier.

The switching circuit may include a sixth switch between the first input terminal of the amplifier and the second input terminal of the amplifier.

Therefore, an organic light emitting display device according to example embodiments of the present invention includes a readout circuit that senses a threshold voltage and a mobility of a driving transistor. A pixel in the organic light emitting display device includes a scan transistor connected to a data line and a sensing transistor connected to a readout line. The scan transistor and the sensing transistor are turned on in response to the same scan signal. At least two pixels that are adjacent to each other and are connected to the same scan line share one readout line. Therefore, the organic light emitting display device can increase the opening ratio of the display panel, reduce manufacturing costs, and sense the threshold voltage or mobility of the driving transistor by including the pixel and the readout circuit that have a relatively simple structure.

In addition, a readout circuit according to example embodiments can effectively sense the threshold voltage and the mobility of the driving transistor with a relatively simple structure.

BRIEF DESCRIPTION OF THE DRAWINGS

Exemplary embodiments will be described more fully hereinafter with reference to the accompanying drawings, in which various embodiments are shown.

DETAILED DESCRIPTION

Exemplary embodiments will be described more fully hereinafter with reference to the accompanying drawings, in which various embodiments are shown.

Figure 1:
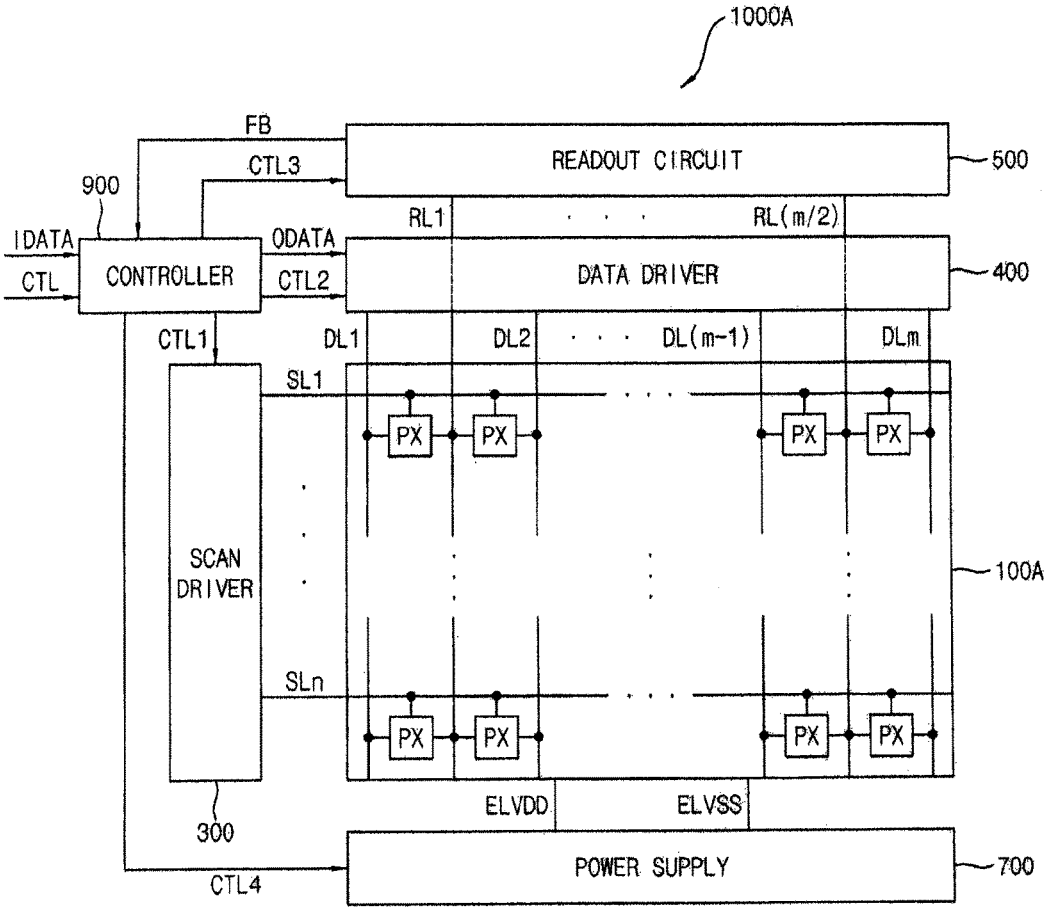
FIG. 1 is a block diagram illustrating an organic light emitting display device according to one example embodiment of the present invention.

FIG. 1 is a block diagram illustrating an organic light emitting display device according to one example embodiment.

Referring to FIG. 1, the organic light emitting display device 1000A may include a display panel 100A, a scan driver 300, a data driver 400, a readout circuit 500, a power supply 700, and a controller 900.

The display panel 100A may include a plurality of pixels PX. For example, the display panel 100A may include n*m pixels PX because the pixels PX are arranged at locations corresponding to crossing regions (or crossing points) of a plurality of scan lines SL1 through SLn and a plurality of data lines DL1 through DLm. In one example embodiment, two pixels connected to one of the scan lines SL1 through SLn may be connected to the same readout line to reduce the number of readout lines and increase an opening ratio of the display panel 100A. For example, first and second pixels that are adjacent to each other and located on the same horizontal line may share the one readout line.

The scan driver 300 may provide a scan signal (or a plurality of scan signals) to the pixels PX via the scan lines SL1 through SLn based on a first control signal CTL1.

The data driver 400 may provide a data signal (or a plurality of data signals) to the pixels PX via the data lines DL1 through DLm based on a second control signal CTL2.

The readout circuit 500 may be connected to the pixels PX via a plurality of readout lines RL1 through RL(m/2). In one embodiment, the readout lines RL1 through RL(m/2) extend along a direction parallel to the data lines DL1 through DLm and, like the data lines, the readout lines RL1 through RL(m/2) cross the scan lines SL1 through SLn. The readout circuit 500 may sense a characteristic deviation (e.g., a threshold voltage and a mobility) of a driving transistor based on a third control signal CTL3 and provide a feedback data FB including the sensed characteristic deviation to the controller 900.

The readout circuit 500 may sense the threshold voltage of the driving transistor of the pixel PX during (or in) a voltage sensing period. For example, the voltage sensing period may exist between display periods. Therefore, the readout circuit 500 can sense the threshold voltage of the driving transistor to compensate the threshold voltage while the organic light emitting display device 1000A operates to display an image. The readout circuit 500 may sense the mobility of the driving transistor during a current sensing period. For example, the current sensing period may exist in (or take place during) a power off (or shutdown) operation of the organic light emitting display device 1000A.

In one example embodiment, the readout circuit 500 may include a current-voltage converter for converting a current flowing through the readout line into a first voltage, an analog-digital converter for converting the first voltage or a second voltage of the readout line into a digital data, and a switching circuit for controlling a connection among the readout line, the current-voltage converter, and the analog-digital converter. Hereinafter, the readout circuit 500 will be described in more detail with reference to the FIG. 3.

The power supply 700 may provide a power or a power source to the display panel 100A based on a fourth control signal CTL4. The power supply 700 may generate a first power source (or first power or first voltage) ELVDD and a second power source (or second power or second voltage) ELVSS and provide the first power source ELVDD and the second power source ELVSS to the display panel 100A. In one example embodiment, a second electrode of the organic light emitting diode may be connected to the second power source ELVSS during the display period. The second electrode of the organic light emitting diode may be connected to the first power source ELVDD during the voltage sensing period and the current sensing period.

The controller 900 may receive an input control signal CTL. The controller 900 may generate first, second, third, and fourth control signals CTL1, CTL2, CTL3, and CTL4 based on the input control signal CTL to control the scan driver 300, the data driver 400, the readout circuit 500, and the power supply 700. In addition, the controller 900 may receive the feedback data FB including the sensed characteristic deviation (or deviations) of the driving transistor (or transistors) from the readout circuit 500. The controller 900 may convert input image data IDATA into output image data ODATA based on the feedback data FB to compensate for the characteristic deviation (or deviations) of the driving transistor (or driving transistors).

Therefore, the pixel PX and readout circuit 500 may have a relatively simple structure. Accordingly, the organic light emitting display device 1000A according to embodiments of the present invention can increase the opening ratio of the display panel 100A, reduce a manufacturing cost, and sense the threshold voltage or the mobility of the driving transistor.

Figure 2:
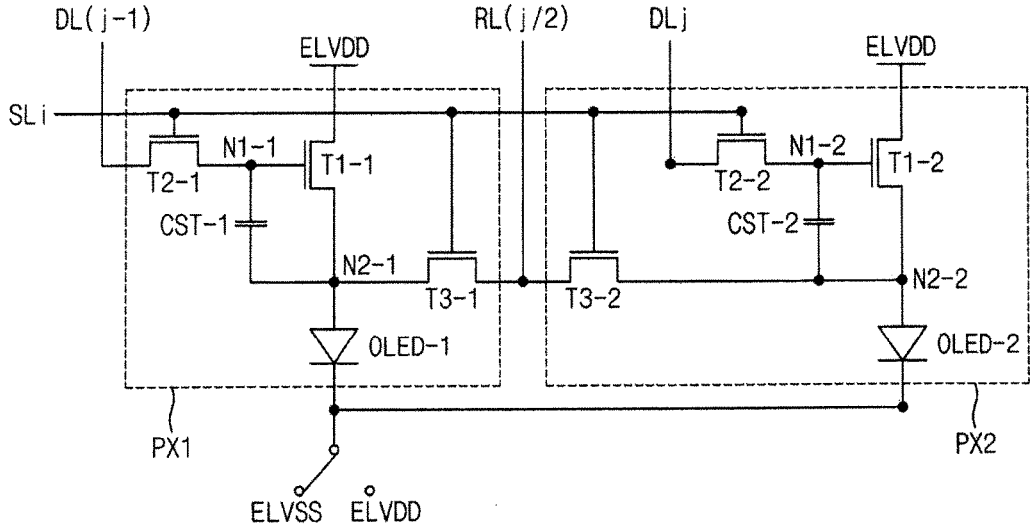
FIG. 2 is a circuit diagram illustrating an example of pixels included in an organic light emitting display device of FIG. 1.

FIG. 2 is a circuit diagram illustrating an example of pixels included in an organic light emitting display device of FIG. 1.

Referring to FIG. 2, each pixel PX1 or PX2 may include a scan transistor T2-1 or T2-2 connected to a data line DL(j−1) or DLj and a sensing transistor T3-1 or T3-2 connected to a readout line RL(j/2) (e.g., the same readout line RL(j/2). The scan transistor T2-1 or T2-2 and the sensing transistor T3-1 or T3-2 may be turned on in response to the same scan signal. Also, a first pixel PX1 and a second pixel PX2 that are adjacent to each other and connected to the same scan line (e.g., the first pixel PX1 and the second pixel PX2 are in a same row) may share one readout line RL(j/2).

In one example embodiment, each pixel PX1 or PX2 may include a first transistor T1-1 or T1-2, a second transistor T2-1 or T2-2, a third transistor T3-1 or T3-2, a storage capacitor CST-1 or CST-2, and an organic light emitting diode OLED-1 or OLED-2. The first transistor T1-1 or T1-2 may be the driving transistor. The first transistor T1-1 or T1-2 may include a gate electrode connected to a first node N1-1 or N1-2, a first electrode a first power source ELVDD, and a second electrode connected to a second node N2-1 or N2-2. The second transistor T2-1 or T2-2 may include a gate electrode connected to the scan line SLi, a first electrode connected to the data line DL(j−1) or DLj, and a second electrode connected to the first node N1-1 or N1-2. The third transistor T3-1 or T3-2 may include a gate electrode connected to the scan line SLi, a first electrode connected to the second node N2-1 or N2-2, and a second electrode connected to the readout line RL(j/2). The storage capacitor CST-1 or CST-2 may be connected between the first node N1-1 or N1-2 and the second node N2-1 or N2-2. The original emitting diode OLED-1 or OLED-2 may include a first electrode connected to the second node N2-1 or N2-2 and a second electrode selectively connected to the first power source ELVDD or the second power source ELVSS.

In one example embodiment, the second electrode of the original emitting diode OLED-1 or OLED-2 may be connected to the second power source ELVSS during the display period. The second electrode of the original emitting diode OLED-1 or OLED-2 may be connected to the first power source ELVDD during the voltage sensing period and the current sensing period. Thus, in order to flow a driving current through the original emitting diode OLED-1 or OLED-2, the second electrode of the original emitting diode OLED-1 or OLED-2 may be connected to the second power source ELVSS during the display period. Also, in order to reduce or prevent a current from flowing through the original emitting diode OLED-1 or OLED-2, the second electrode of the original emitting diode OLED-1 or OLED-2 may be connected to the first power source ELVDD during the voltage sensing period and the current sensing period.

Therefore, the one readout line is shared by the first pixel PX1 and the second pixel PX2 to improve the opening ratio of the display panel. In a comparative pixel, if the characteristic deviation of the driving transistor is sensed via a power line, a voltage drop of the power source can occur because the data line and the power line are formed in (e.g., along) the same direction. However, in the display panel according to aspects of embodiments of the present invention, the data line and the power line may be orthogonal to each other, thereby reducing the effect of the voltage drop.

Figure 3:
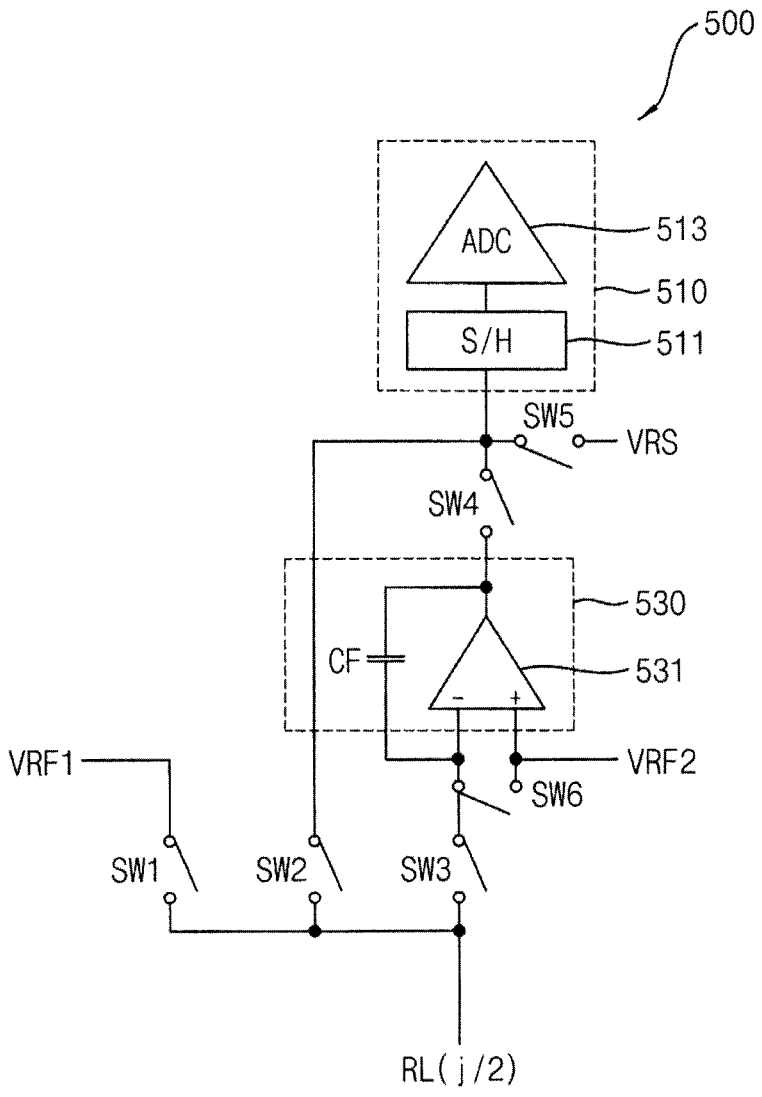
FIG. 3 is a circuit diagram illustrating an example of a readout circuit included in an organic light emitting display device of FIG. 1.

FIG. 3 is a circuit diagram illustrating an example of a readout circuit included in an organic light emitting display device of FIG. 1.

Referring to FIG. 3, the readout circuit 500 may include an analog-digital converter 510, a current-voltage converter 530, and a switching circuit.

The analog-digital converter 510 may convert a first voltage of an output terminal of the current-voltage converter 530 or a second voltage of the readout line RL(j/2) into a digital data. In one example embodiment, the analog-digital converter 510 may include a sampling-holding circuit (or sample and hold circuit) 511 and an analog-digital converting circuit 513. The sampling-holding circuit 511 may sample and hold the first voltage or the second voltage so as to output a readout voltage. The analog-digital converting circuit 513 may convert the readout voltage into the digital data.

The current-voltage converter 530 may convert a current flowing from the readout line RL(j/2) into the first voltage. For example, the current-voltage converter 530 may be a transimpedance amplifier that is converting a magnitude of an input current into a voltage.

In one example embodiment, the current-voltage converter 530 may include an amplifier 531 and a feedback capacitor CF. The amplifier 531 may include a first input terminal connected to the readout line RL(j/2) via the switching circuit, a second input terminal connected to a second reference power source VRF2, and an output terminal connected to the analog-digital converter 510 via the switching circuit. The feedback capacitor CF may be connected between the output terminal of the amplifier 531 and the first input terminal of the amplifier 531.

The switching circuit may control a connection among the readout line RL(j/2), the current-voltage converter 530, and the analog-digital converter 510. The switching circuit may control the connection such that a voltage of a first reference power source VRF1 is applied to the readout line RL(j/2) during the display period. The switching circuit may connect the readout line RL(j/2) to the analog-digital converter 510 in order to sense the threshold voltage of the driving transistor during the voltage sensing period. The switching circuit may connect the readout line RL(j/2) to the current-voltage converter 530 and connect the current-voltage converter 530 to the analog-digital converter 510 in order to sense the mobility of the driving transistor during the current sensing period.

In one example embodiment, the switch circuit may include first, second, third fourth, fifth, and sixth switches SW1, SW2, SW3, SW4, SW5, and SW6. The first switch SW1 may be located between the readout line RL(j/2) and the first reference power source VRF1. The second switch SW2 may be located between the readout line RL(j/2) and the analog-digital converter 510. The third switch SW3 may be located between the readout line RL(j/2) and the current-voltage converter 530. The fourth switch SW4 may be located between the current-voltage converter 530 and the analog-digital converter 510. The fifth switch SW5 may be located between the analog-digital converter 510 and a reset power source VRS. The sixth switch SW6 may be located between the first input terminal of the amplifier 531 and the second input terminal of the amplifier 531. Hereinafter, operations of the first, second, third fourth, fifth, and sixth switches SW1, SW2, SW3, SW4, SW5, and SW6 will be described in more detail with reference to the FIGS. 4, 5, 6, 7, 8, and 9.

Figure 4:
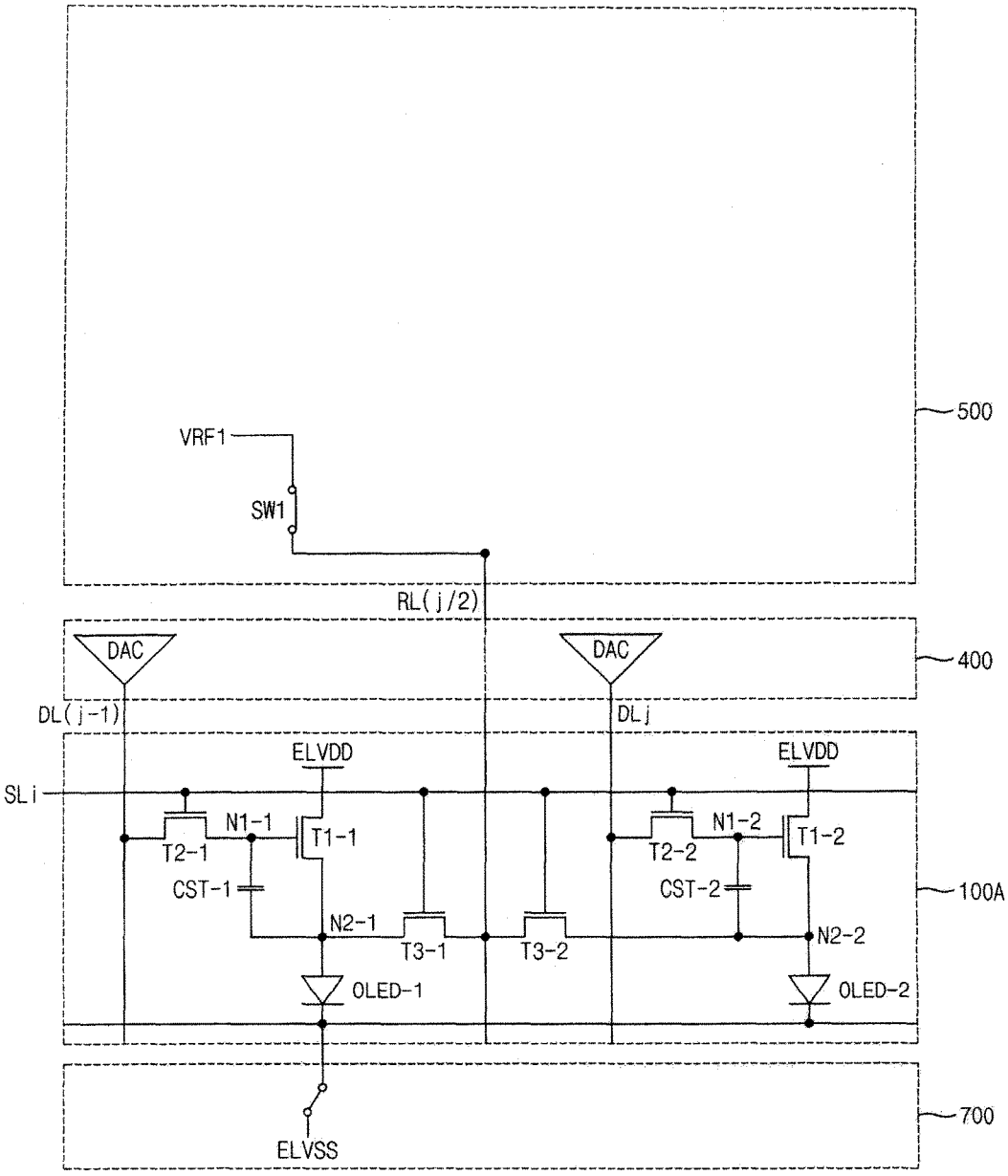
FIGS. 4 and 5 are diagrams for describing an operation of an organic light emitting display device of FIG. 1 during a display period.
Figure 5:
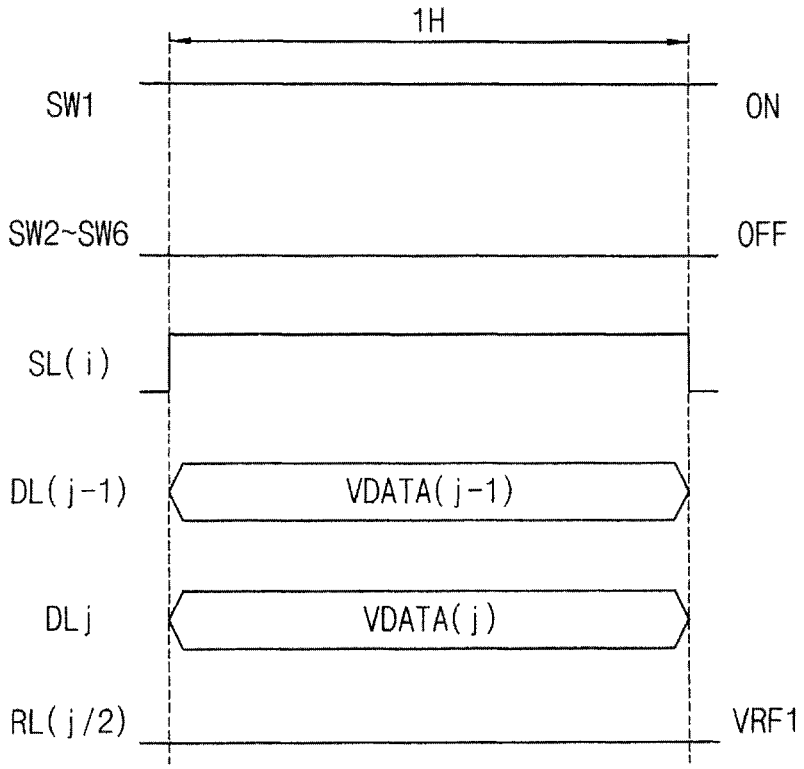

FIGS. 4 and 5 are diagrams for describing an operation of an organic light emitting display device of FIG. 1 during a display period.

Referring to FIGS. 4 and 5, the readout circuit 500 may apply a voltage of a first reference power source VRF1 to a readout line RL(j/2) during the display period. The pixels may emit the light corresponding to a data signal in response to a scan signal.

During one horizontal period 1H of the display period, a first switch SW1 in the readout circuit 500 may be turned on and second through sixth switch SW2 through SW6 may be turned off. Therefore, the readout circuit 500 may apply a voltage of the first reference power source VRF1 to the readout line RL(j/2) such that an image is normally displayed without sensing a characteristic deviation of the driving transistor during the display period. The scan driver may progressively output the scan signal (or scan signals) to the scan lines. For example, a second transistor T2-1 or T2-2 and a third transistor T3-1 or T3-2 may be turned-on concurrently (e.g., simultaneously) in response to the scan signal supplied to the scan line coupled to the second transistor T2-1 or T2-2 and the third transistor T3-1 or T3-2. A storage capacitor CST-1 or CST-2 may charge (or store) a charging voltage corresponding to a voltage difference between a data signal VDATA(j−1) or VDATA(j) and a first reference voltage VRF1. The storage capacitor CST-1 or CST-2 may provide the charging voltage to the driving transistor (e.g., a first transistor T1-1 or T1-2), even if the second transistor T2-1 or T2-2 and the third transistor T3-1 or T3-2 are turned off. The second power voltage ELVSS may be applied to a second electrode of an organic light emitting diode OLED-1 or OLED-2. Therefore, a current corresponding to the driving voltage may flow through the organic light emitting diode OLED-1 or OLED-2. The pixels may emit the light corresponding to the data signal.

Figure 6:
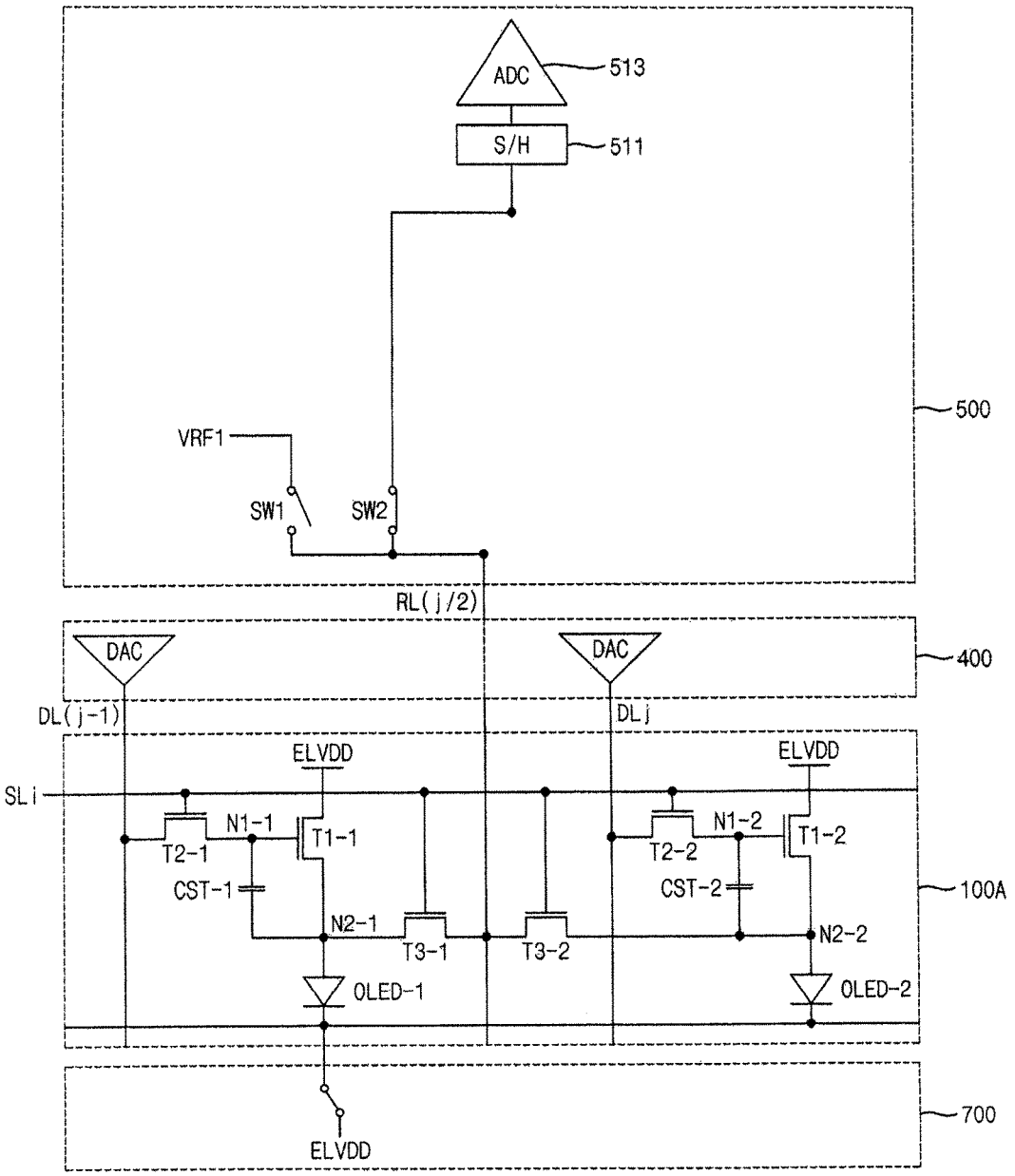
FIGS. 6 and 7 are diagrams for describing an operation of an organic light emitting display device of FIG. 1 during a voltage sensing period.
Figure 7:
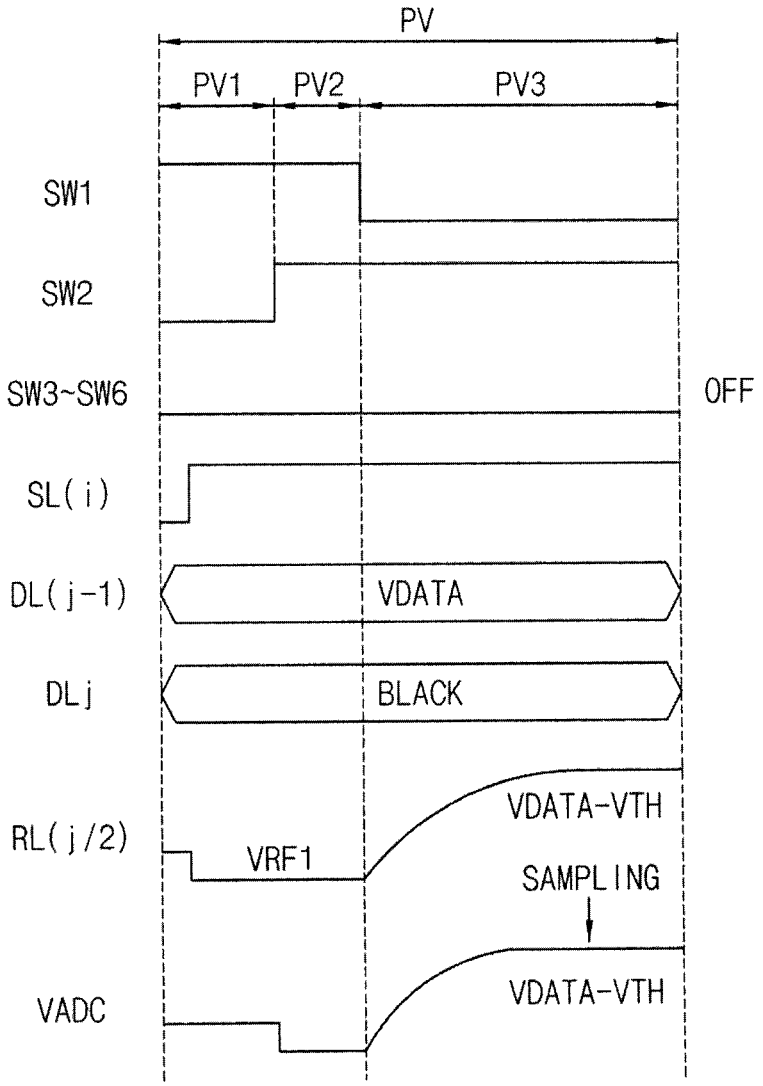

FIGS. 6 and 7 are diagrams for describing an operation of an organic light emitting display device of FIG. 1 during a voltage sensing period.

Referring to FIGS. 6 and 7, the readout circuit 500 may connect the readout line RL(j/2) to an analog-digital converter during a voltage sensing period PV, thereby sensing a threshold voltage of a first transistor T1-1 that is a driving transistor of a first pixel.

First and second pixels that share the readout line RL(j/2) may receive a scan signal from a connected scan line SL(i) during the voltage sensing period PV. Because a threshold voltage of one driving transistor can be sensed via the readout line RL(j/2) in one voltage sensing period, the first pixel may receive a first data voltage (e.g., a predetermined first data voltage) VDATA as the data signal and the second pixel may receive a second data voltage BLACK corresponding to black data during the voltage sensing period PV. The third switch SW3, the fourth switch SW4, the fifth switch SW5, and the sixth switch SW6 may be turned off during the voltage sensing period PV.

Specifically, in a first period PV1 of the voltage sensing period PV, the first switch SW1 may be turned on and the second switch SW2 may be turned off. Therefore, the first reference voltage VRF1 may be applied to the readout line RL(j/2) and the readout line RL(j/2) may be initialized in the first period PV1.

In a second period PV2 of the voltage sensing period PV, the first switch SW1 and the second switch SW2 may be turned on. Therefore, the first reference voltage VRF1 may be applied to a sampling-holding circuit 511 of an analog-digital converter and the sampling-holding circuit 511 may be initialized in the second period PV2.

In a third period PV3 of the voltage sensing period PV, the first switch SW1 may be turned off and the second switch SW2 may be turned on. In a first pixel, a current flowing from the first transistor T1-1 may be outputted via the third transistor T3-1 that is turned on and the readout line RL(j/2). A voltage of the readout line RL(j/2) may increase in proportional to the current flowing from the first transistor T1-1. When a voltage of the storage capacitor CST-1 reaches the threshold voltage VTH of the first transistor T1-1, the voltage of the readout line RL(j/2) may be saturated at a voltage difference VDATA-VTH between the first data voltage VDATA and the threshold voltage VTH of the first transistor T1-1. At this time, the threshold voltage VTH of the first transistor T1-1 (e.g., the driving transistor) may be derived by sampling the voltage VDATA-VTH of the readout line RL(j/2).

Figure 8:
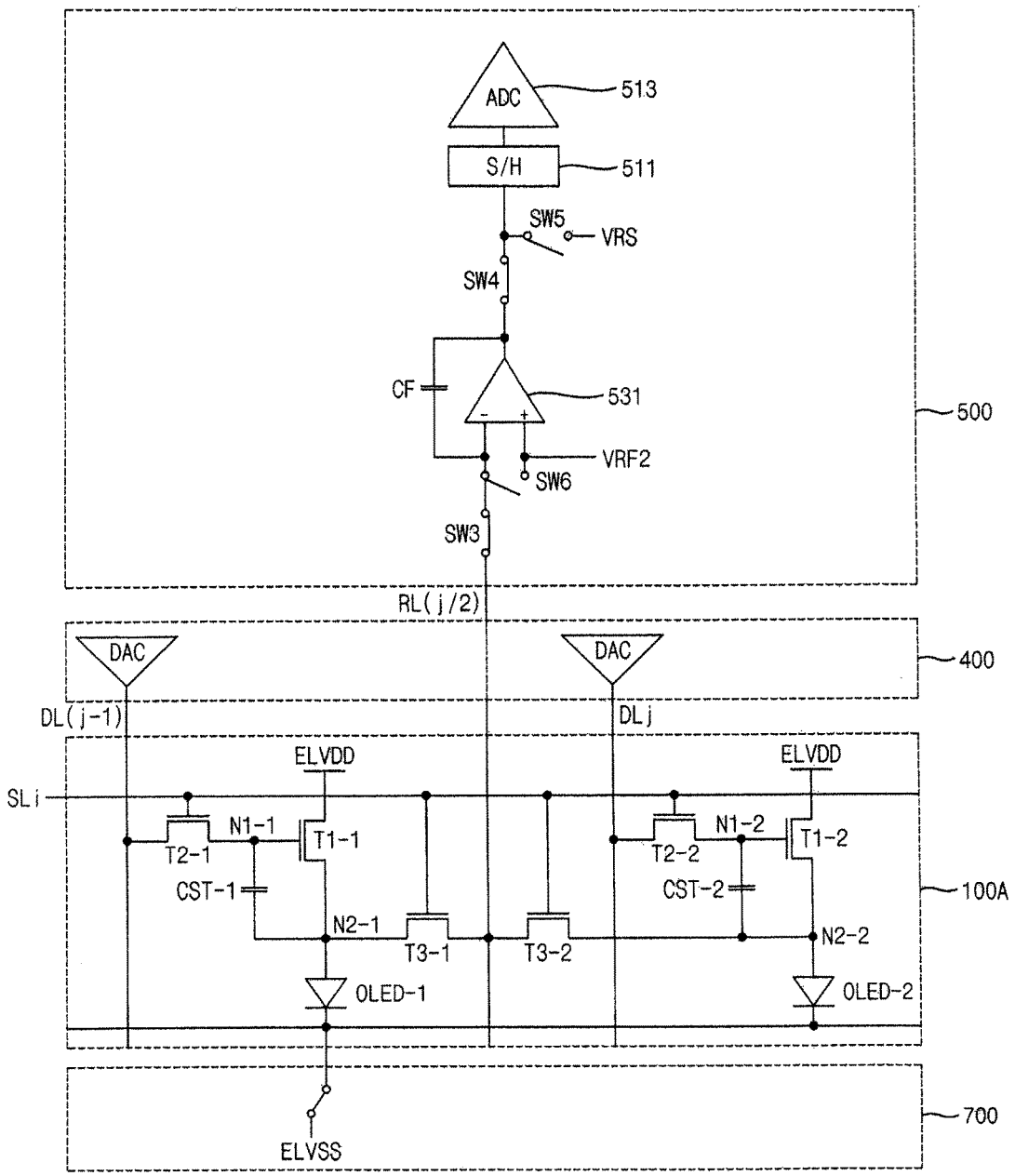
FIGS. 8 and 9 are diagrams for describing an operation of an organic light emitting display device of FIG. 1 during a current sensing period.
Figure 9:
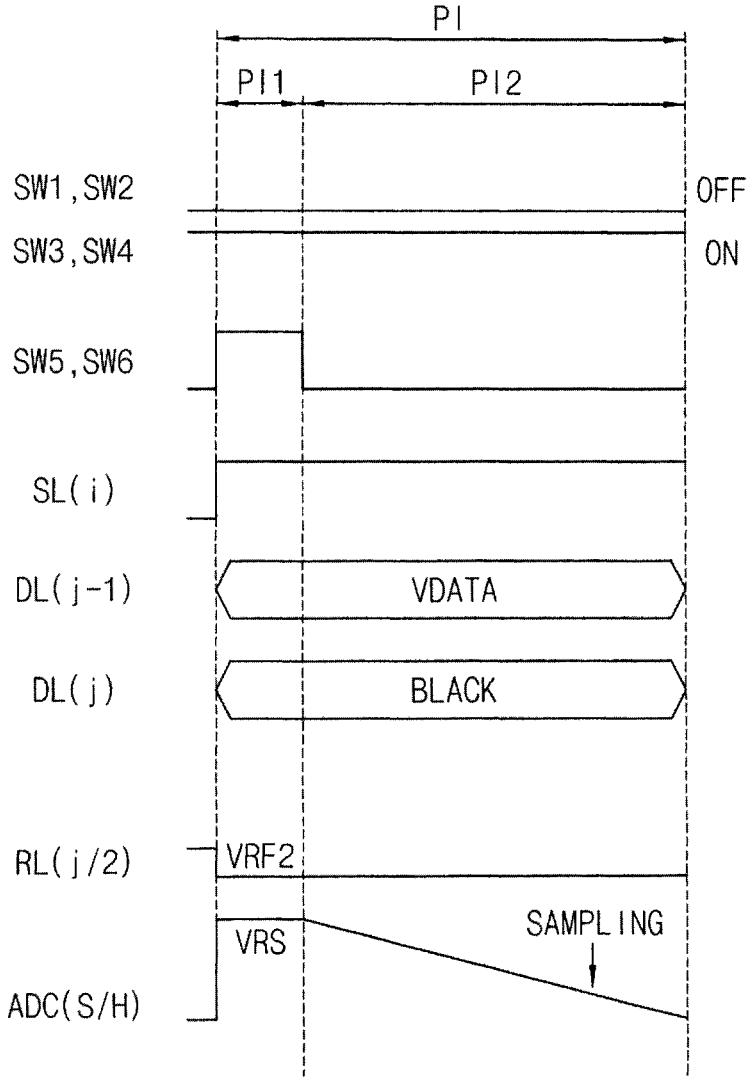

FIGS. 8 and 9 are diagrams for describing an operation of an organic light emitting display device of FIG. 1 during a current sensing period.

Referring to FIGS. 8 and 9, the readout circuit 500 may connect a readout line RL(j/2) to a current-voltage converter during the current sensing period PI, connect the current-voltage converter to an analog-digital converter. The readout circuit 500 may sense a mobility of a first transistor T1-1 that is a driving transistor.

First and second pixels that share the readout line RL(j/2) may receive a scan signal from a connected scan line SL(i) during the current sensing period PI. Because a mobility of one driving transistor (e.g., only one driving transistor) can be sensed via the readout line RL(j/2) during one current sensing period PI, the first pixel may receive a first data voltage (e.g., a predetermined first data voltage) VDATA as the data signal and the second pixel may receive a second data voltage BLACK corresponding to black data during the current sensing period PI. The first switch SW1 and the second switch SW2 may be turned off, and the third switch SW3 and the fourth switch SW4 may be turned on in order to operate the current-voltage converter during the current sensing period PI.

Specifically, in a first period PI1 of the current sensing period PI, the fifth switch SW5 and the sixth switch SW6 may be turned on. Therefore, the second reference voltage VRF2 may be applied to the readout line RL(j/2) and the readout line RL(j/2) may be initialized in the first period PI1. Also, a voltage of a reset power source VRS may be applied to a sampling-holding circuit 511 of the analog-digital converter and the sampling-holding circuit 511 of the analog-digital converter may be initialized in the first period PI1.

During a second period PI2 of the current sensing period PI, the fifth switch SW5 and the sixth switch SW6 may be turned off. Therefore, the voltage of the reset power source VRS may be not applied to the sampling-holding circuit 511 of the analog-digital converter. In a first pixel, a data voltage may be applied to a gate electrode of the first transistor T1-1 (e.g., the driving transistor). The second reference voltage VRF2 may be applied to the second electrode of the first transistor T1-1 by a virtual short of the amplifier included in the current-voltage converter. As a result, a driving voltage of the first transistor T1-1 may be a difference voltage VDATA-VRF2 between the first data voltage VDATA and the second reference voltage VRF2. A voltage VADC applied to the sampling-holding circuit 511 may gradually decrease from the voltage of the reset power source VRS by the current-voltage converter that is a transimpedance amplifier. Here, the mobility of the first transistor may be derived using Equation 1 below:

$$VADC = VRS - \frac{1}{C}\int_0^t \left| \right| dt \qquad \text{Equation 1}$$

Where VADC is the voltage applied to the sampling-holding circuit, VRS is the voltage of the reset power source, C is a capacitance of the feedback capacitor, t is a time during which the voltage decreases (or voltage decreasing time), and I is a readout current. Therefore, the readout current may be determined according to the capacitance of the feedback capacitor, the voltage decreasing time, and a decreased voltage according to the voltage decreasing time.

Figure 10:
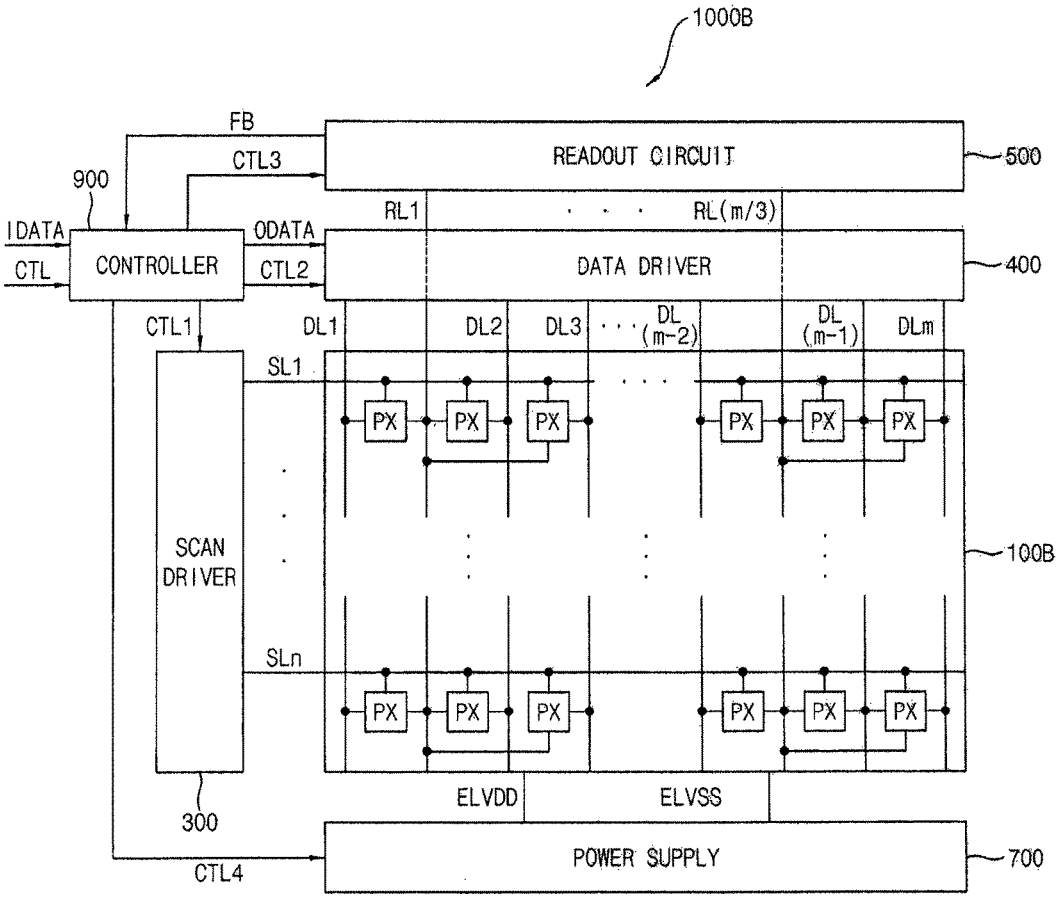
FIG. 10 is a block diagram illustrating an organic light emitting display device according to another example embodiment of the present invention.

FIG. 10 is a block diagram illustrating an organic light emitting display device according to another example embodiment.

Referring to FIG. 10, the organic light emitting display device 1000B may include a display panel 100B, a scan driver 300, a data driver 400, a readout circuit 500, a power supply 700, and a controller 900. The organic light emitting display device 1000B according to the present exemplary embodiment is substantially the same as the organic light emitting display device of the exemplary embodiment described in FIG. 1, except that three pixels that are connected the same scan line share one readout line. Therefore, the same reference numerals will be used to refer to the same or like parts as those described in the previous exemplary embodiment of FIG. 1, and any repetitive explanation concerning the above elements will be omitted.

The display panel 100B may include a plurality of pixels PX. For example, the display panel 100B may include n*m pixels PX because the pixels PX are arranged at locations corresponding to crossing regions of a plurality of scan lines SL1 through SLn and a plurality of data lines DL1 through DLm. In one example embodiment, three pixels connected to one of the scan lines SL1 through SLn may be connected to the same readout line to reduce the number of readout lines and increase an opening ratio of the display panel 100B. For example, first, second, and third pixels that are adjacent to each other and located on the same horizontal line may share one readout line.

The scan driver 300 may provide a scan signal to the pixels PX via the scan lines SL1 through SLn based on a first control signal CTL1. The data driver 400 may provide a data signal to the pixels PX via the data lines DL1 through DLm based on a second control signal CTL2.

The readout circuit 500 may be connected to the pixels PX via a plurality of readout lines RL1 through RL(m/3). The readout circuit 500 may sense a characteristic deviation (e.g., a threshold voltage and a mobility) of a driving transistor based on a third control signal CTL3 and provide feedback data FB including the sensed characteristic deviation to the controller 900.

The power supply 700 may provide a power source to the display panel 100B based on a fourth control signal CTL4. The power supply 700 may generate a first power source ELVDD and a second power source ELVSS and provide the first power source ELVDD and the second power source ELVSS to the display panel 100B.

The controller 900 may receive an input control signal CTL. The controller 900 may generate first, second, third, and fourth control signals CTL1, CTL2, CTL3, and CTL4 based on the input control signal CTL to control the scan driver 300, the data driver 400, the readout circuit 500, and the power supply 700. In addition, the controller 900 may receive the feedback data FB including data for the sensed characteristic deviation of the driving transistor from the readout circuit 500. The controller 900 may convert input image data IDATA into output image data ODATA based on the feedback data FB to compensate the characteristic deviation of the driving transistor.

Figure 11:
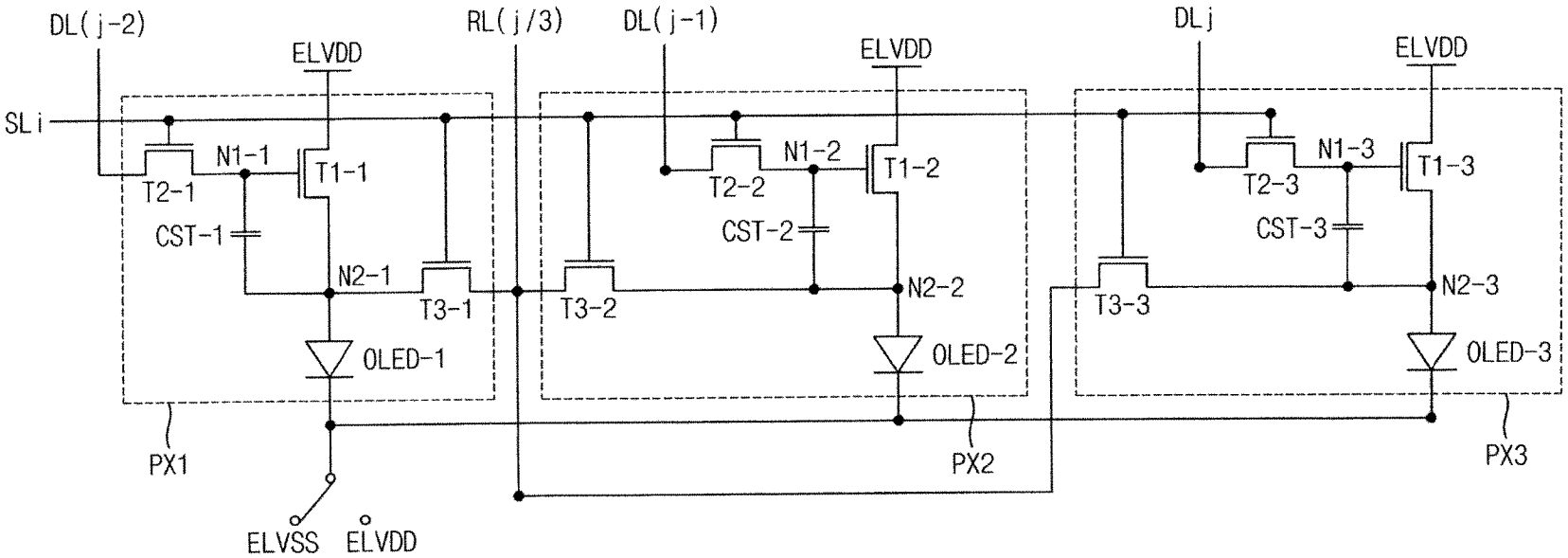
FIG. 11 is a circuit diagram illustrating an example of a pixel included in an organic light emitting display device of FIG. 10.

FIG. 11 is a circuit diagram illustrating an example of a pixel included in an organic light emitting display device of FIG. 10.

Referring to FIG. 11, each pixel PX1, PX2, or PX3 may include a scan transistor T2-1, T2-2, or T2-3 connected to a data line DL(j−2), DL(j−1), or DLj and a sensing transistor T3-1, T3-2, or T3-3 connected to a readout line RL(j/3) (e.g., the same readout line RL(j/3)) The scan transistor T2-1, T2-2, or T2-3 and the sensing transistor T3-1, T3-2, or T3-3 may be turned on in response to the same scan signal.

In one example embodiment, each pixel PX1, PX2, or PX3 may include a first transistor T1-1, T1-2, or T1-3, a second transistor T2-1, T2-2, or T2-3, a third transistor T3-1, T3-2, or T3-3, a storage capacitor CST-1, CST-2, or CST-3, and an organic light emitting diode OLED-1, OLED-2, or OLED-3. Because the structure of the pixel is described above, duplicated descriptions will be omitted.

The first, second, and third pixels PX1, PX2, and PX3 that are connected to the same scan line SLi may share the one readout line RL(j/3). For example, the display panel 100B may include the pixels that are arranged in stripe pattern. In one example embodiment, the first, second, and third pixels PX1, PX2, and PX3 respectively include a red color organic light emitting diode, a green color organic light emitting diode, and a blue color organic light emitting diode. Because the number of the readout lines decreases when the plurality of pixels share the one readout line, the opening ratio of the display panel 100B can increase.

In one example embodiment, one pixel of the first through third pixels may receive a first data voltage as the data signal during a voltage sensing period and a current sensing period. The other pixels among the first and third pixels may receive a second voltage corresponding to a black data (e.g., no light emission) as the data signal during the voltage sensing period and the current sensing period because the threshold voltage or the mobility of one driving transistor (e.g., only one driving transistor) can be sensed via the readout line RL(j/3) during one voltage sensing period or one current sensing period.

Therefore, the first, second, and third pixels PX1, PX2, and PX3 that are connected to the same scan line SLi share the one readout line RL(j/3), thereby increasing the opening ratio of the display panel 100B.

Although the example embodiments describe that the readout circuit and the data driver are implemented in each integrated circuit (IC) chip, the readout circuit and the data driver are implemented in the same IC chip.

Aspects of embodiments of the present invention may be applied to an electronic device having the organic light emitting display device. For example, the present inventive concept may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and equivalents thereof.

What is claimed is:

1. An organic light emitting display device comprising:
- a display panel comprising a plurality of pixels;
- a scan driver configured to provide a scan signal to the pixels via a plurality of scan lines;
- a data driver configured to provide a data signal to the pixels via a plurality of data lines; and
- a readout circuit connected to the pixels via a plurality of readout lines, the readout circuit comprising:
  - a current-voltage converter configured to convert a current flowing through one of the readout lines into a first voltage;
  - an analog-digital converter configured to convert the first voltage or a second voltage of the one of the readout lines into a digital data; and
  - a switching circuit configured to selectively directly connect the one of the readout lines to one of:
    - the current-voltage converter; and
    - the analog-digital converter.

2. The display device of claim 1, wherein the switching circuit includes:
- a first switch between the one of the readout lines and a first reference power source;
- a second switch between the one of the readout lines and the analog-digital converter;
- a third switch between the one of the readout lines and the current-voltage converter;
- a fourth switch between the current-voltage converter and the analog-digital converter; and
- a fifth switch between the analog-digital converter and a reset power source.

3. The display device of claim 2, wherein the first switch is configured to be turned on during a display period, and
- wherein the second switch and the third switch are configured to be turned off during the display period.

4. The display device of claim 2, wherein the second switch is configured to be turned on in at least a part of a voltage sensing period, and
- wherein the third switch, the fourth switch, and the fifth switch are configured to be turned off during the voltage sensing period.

5. The display device of claim 4, wherein the first switch is configured to be turned on in at least a part of the voltage sensing period.

6. The display device of claim 2, wherein the first switch and the second switch are configured to be turned off during a current sensing period, and
- wherein the third switch and the fourth switch are configured to be turned on during the current sensing period.

7. The display device of claim 6, wherein the fifth switch is configured to be turned on during at least a part of the current sensing period.

8. The display device of claim 1, wherein the analog-digital converter comprises:
- a sampling-holding circuit configured to sample and hold the first voltage or the second voltage so as to output a readout voltage; and
- an analog-digital converting circuit configured to convert the readout voltage into the digital data.

9. An organic light emitting display device comprising:
- a display panel comprising a plurality of pixels;
- a scan driver configured to provide a scan signal to the pixels via a plurality of scan lines;
- a data driver configured to provide a data signal to the pixels via a plurality of data lines; and
- a readout circuit connected to the pixels via a plurality of readout lines, the readout circuit comprising:
  - a current-voltage converter configured to convert a current flowing through one of the readout lines into a first voltage;
  - an analog-digital converter configured to convert the first voltage or a second voltage of the one of the readout lines into a digital data; and
- a switching circuit configured to control a connection among the one of the readout lines, the current-voltage converter, and the analog-digital converter, wherein the current-voltage converter comprises:
- an amplifier comprising a first input terminal connected to the one of the readout lines via the switching circuit, a second input terminal connected to a second reference power source, and an output terminal connected to the analog-digital converter via the switching circuit; and
- a feedback capacitor connected between the output terminal of the amplifier and the first input terminal of the amplifier.

10. The display device of claim 9, wherein the switching circuit comprises:
- a sixth switch between the first input terminal of the amplifier and the second input terminal of the amplifier.

11. The display device of claim 10, wherein the sixth switch is configured to be turned on during at least a part of a current sensing period.

12. The display device of claim 1, wherein each of the pixels comprises:

a first transistor comprising a gate electrode connected to a first node, a first electrode, a first power source, and a second electrode connected to a second node;

a second transistor comprising a gate electrode connected to one of the scan lines, a first electrode connected to one of the data lines, and a second electrode connected to the first node;

a third transistor comprising a gate electrode connected to the one of the scan lines, a first electrode connected to the second node, and a second electrode connected to one of the readout lines;

a storage capacitor connected between the first node and the second node; and an original emitting diode comprising a first electrode connected to the second node and a second electrode selectively connected to the first power source or a second power source.

13. The display device of claim 12, wherein the second electrode of the original emitting diode is configured to be connected to the second power source during a display period and connected to the first power source during a voltage sensing period and a current sensing period.

14. The display device of claim 1, wherein at least two pixels connected to one of the scan lines are all connected to one of the readout lines.

15. The display device of claim 14, wherein first, second, and third pixels connected to the one of the scan lines are all connected to the one of the readout lines, and wherein the first, second, and third pixels respectively include a red color organic light emitting diode, a green color organic light emitting diode, and a blue color organic light emitting diode.

16. The display device of claim 15, wherein the first pixel receives a first data voltage as the data signal during a voltage sensing period and a current sensing period, and wherein the second and third pixels receive a second voltage corresponding to a black data as the data signal during the voltage sensing period and the current sensing period.

17. A readout circuit comprising:

a current-voltage converter configured to convert a current flowing through a readout line into a first voltage;

an analog-digital converter configured to convert the first voltage or a second voltage of the readout line into a digital data; and a switching circuit configured to selectively directly connect the readout line to one of:

the current-voltage converter; and the analog-digital converter.

18. The readout circuit of claim 17, wherein the switching circuit includes:

a first switch between the readout line and a first reference power source;

a second switch between the readout line and the analog-digital converter;

a third switch between the readout line and the current-voltage converter;

a fourth switch between the current-voltage converter and the analog-digital converter; and a fifth switch between the analog-digital converter and a reset power source.

19. The readout circuit of claim 17, wherein the current-voltage converter includes:

an amplifier including a first input terminal connected to the readout line via the switching circuit, a second input terminal connected to a second reference power source, and an output terminal connected to the analog-digital converter via the switching circuit; and a feedback capacitor connected between the output terminal of the amplifier and the first input terminal of the amplifier.

20. The readout circuit of claim 19, wherein the switching circuit includes:

a sixth switch between the first input terminal of the amplifier and the second input terminal of the amplifier.

* * * * *